US005711433A

United States Patent [19]

Smith

[11] Patent Number: 5,711,433

[45] Date of Patent: Jan. 27, 1998

[54] POTTED PLANT BRACKET

[76] Inventor: Carson Kelly Smith, 13959 SE. Briggs St., Oak Grove, Oreg. 97267

[21] Appl. No.: 422,138

[22] Filed: Apr. 13, 1995

[51] Int. Cl.[6] ..... A47F 5/00

[52] U.S. Cl. ..... 211/71; 211/113; 47/39 C; 248/311.2; 248/312.1

[58] Field of Search ..... 211/71, 113; 47/39, 47/39 C; 248/312.1, 311.2, 214, 215, 310, 219.2; D6/403, 405; 232/17

[56] References Cited

U.S. PATENT DOCUMENTS

| | | | |
|---|---|---|---|
| 1,446,036 | 2/1923 | Dodd | 211/71 |
| 1,472,461 | 10/1923 | Comstock | 248/318 X |
| 1,756,461 | 4/1930 | Hanson | 248/318 X |
| 2,367,256 | 1/1945 | Atkins | 248/312.1 X |
| 3,312,441 | 4/1967 | Molenda | 248/312.1 X |
| 3,498,576 | 3/1970 | Alissandratos | 248/219.2 X |
| 4,623,113 | 11/1986 | Studebaker | 47/39 C X |
| 4,825,590 | 5/1989 | Cullinane | 47/39 C X |
| 4,844,399 | 7/1989 | Harm | 248/311.2 |
| 5,320,319 | 6/1994 | Winger et al. | 47/39 X |
| 5,487,476 | 1/1996 | Barfield | 211/71 |

*Primary Examiner*—Robert W. Gibson, Jr.
*Attorney, Agent, or Firm*—Robert L. Harrington

[57] ABSTRACT

A supporting bracket configured to support two planting pots. The bracket is substantially U-shaped and has extending base portions that support the base of a planting pot and has clips that engage the rim of the planting pot to secure the planting pot to the bracket. The bracket may be used singly or in multiples. Multiple brackets may be secured one to another by a simple fastener such as a bolt. The arrangement of the bracket provides for mounting the bracket or bracket assembly on a post, hanging the bracket or bracket assembly from a chain or similar device or simply mounting the bracket or bracket assembly onto a supporting member.

6 Claims, 3 Drawing Sheets

POTTED PLANT BRACKET

FIELD OF THE INVENTION

This invention relates to a supporting bracket and more particularly relates to a supporting bracket arranged for supporting planting pots and the like. The bracket may be used singly or multiple brackets may be assembled together.

BACKGROUND INFORMATION

It is common to plant flowers, herbs and other items into pots. The pots provide for mobility and allow the user to transport and move the planted pots at any time they desire. Plants planted in pots permit an individual to position the pots at any time to provide an aesthetically appealing surrounding. Additionally, those engaged in the sale of plants utilize pots for planting to facilitate the ease of transport by a purchaser.

The planted pots are free standing and may be moved at will. One of the problems with the pot is that it must be placed on a supporting surface such as a shelf or it is simply placed on a low surface such as the ground or a patio, deck and the like.

Many gardeners, however, desire to have the potted plants placed at different elevations and at different locations within their surroundings. The present invention provides a means for placement of the pots at different elevations and at different locations within the surroundings.

BRIEF SUMMARY OF THE INVENTION

A preferred embodiment of the present invention is an inverted U-shaped bracket that is arranged to support two planting pots. The bracket has a supporting base extending from each of the legs of the U to support the base of a planting pot. The bracket has clips positioned on the legs strategic to the supporting base of the bracket that are arranged to engage the rim of the planting pot. The rim of the pot fits under the clip and the support base engages the bottom of the pot to secure the pot to the bracket. Multiple U-shaped brackets may be assembled one to the other to provide a bracket assembly that will support four, six or more pots. A single fastener is utilized to secure multiple brackets together.

The configuration of the U-shaped bracket provides for several mounting arrangements. A single bracket may be utilized to support two planting pots. The single bracket may be mounted on a horizontal member such as a fence rail, it may be hung from an overhead suspension by a device such as a chain and it may be supported on a vertical member such as a post. Similarly, the brackets that are assembled into multiple units may be hung from a chain or supported by a post.

A particular application of the dual pots provided on a U bracket is to decorate mailboxes. Mailboxes are typically of standard size and shape and generally considered somewhat drab in appearance. Yet they are likely positioned at the entrance to a homeowner's property and may be considered to create a first impression. The inverted U bracket can be made to closely fit the curved exterior of a mailbox. The potted plants provided with flowers or flowering plants convey a desirable first impression to the visitors.

Refer now to the drawings and the detailed description for a further understanding of the invention.

DESCRIPTION OF THE PREFERRED EMBODIMENT

Figure 1:
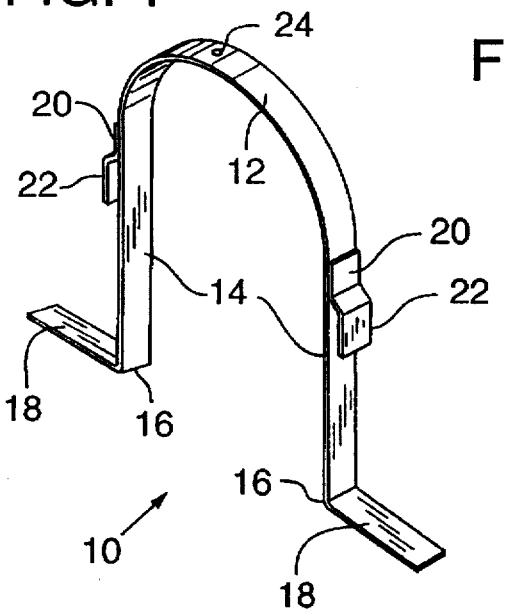
FIG. 1 is a perspective view of a pot supporting bracket of the present invention.

Refer now to FIG. 1 of the drawings which illustrates a preferred embodiment of a bracket 10 of the present invention. The bracket 10 is an inverted U-shaped member that has a crown 12 and has legs 14 extending from the crown 12. Base portions 18 extend outwardly from the lower end 16 of the legs 14 of the bracket 10. The base portions 18 extend substantially normal to the leg portions 14 of the bracket 10. Formed clips 20 are fixedly attached to each of the legs 14 and are positioned strategic to the base portions 18. As shown the clips 20 are formed members such that a bottom portion 22 is spaced at a distance from the leg 14 and is substantially parallel to the leg 14. The clips 20 are securely attached to each of the legs 14 as by welding. A hole (aperture) 24 is provided in the crown 12 and is positioned substantially centrally in the crown 12.

In this embodiment the crown 12 of the bracket 10 is curved in configuration. The crown 12 may be of other configurations, such as a flat portion extending from leg 14 to leg 14, a triangular configuration extending from the legs 14 and others such as a gambrel roof like shape extending from leg 14 to leg 14.

Figure 2:
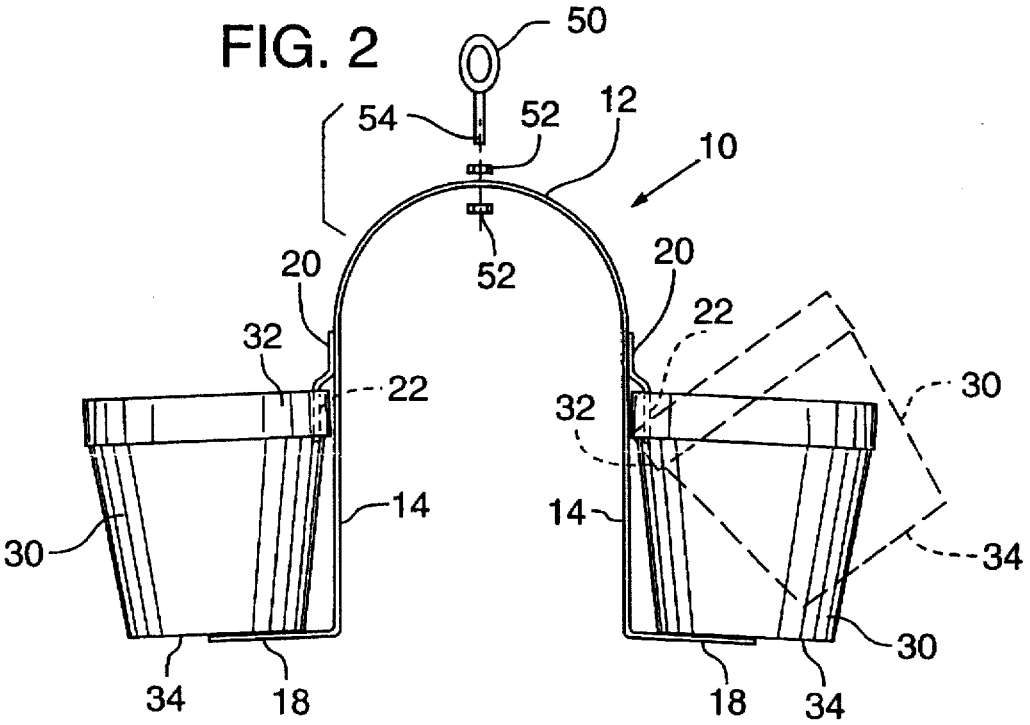
FIG. 2 is a view showing a manner of mounting planting pots to the bracket of FIG. 1.

Refer now to FIG. 2 of the drawings which illustrates the manner of mounting planting pots 30 to the bracket 10 of FIG. 1. The pot 30 is positioned so that its rim 32 is received between the lower portion 22 of the clip 20 and the leg 14 of the bracket 10. The pot 30 is then simply pivoted or tilted so that the base 34 of the pot 30 is received on the extending base portion 18 of the bracket 10. The clip 20 and the base portion 18 in combination secure the pot 30 to the bracket 10.

Figure 3:
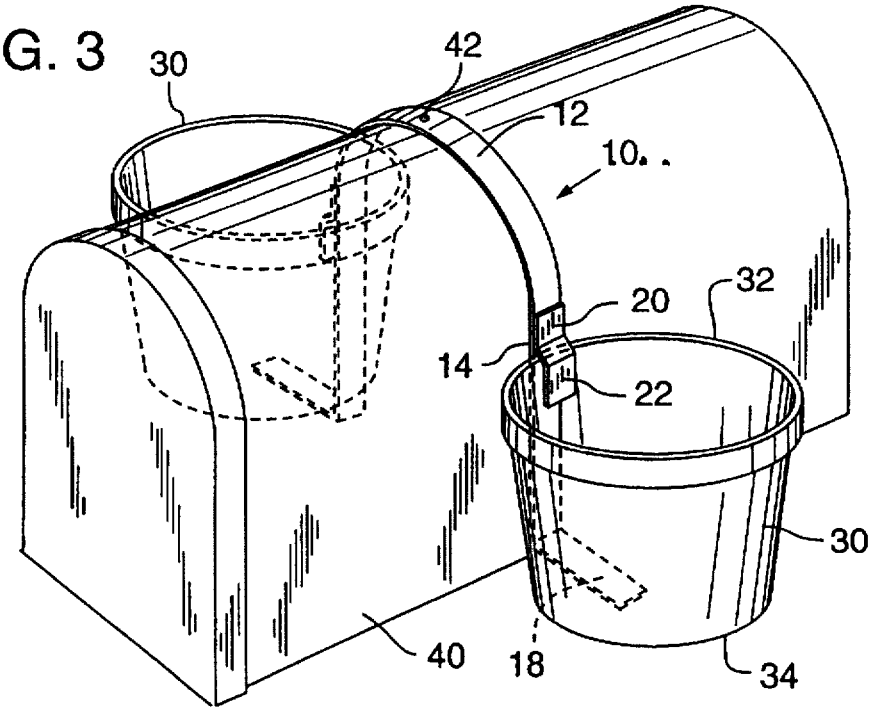
FIG. 3 is a view of the bracket of FIG. 1 mounted on a standard mailbox.

FIG. 3 illustrates the use of a bracket 10 with pots 30 mounted to the bracket 10. This is just but one example of the use of the bracket 10 with pots 30 mounted thereon. In this illustration, the bracket 10 is mounted on a conventional standard mailbox 40. To fixedly secure the bracket 10 to the mailbox 40, a bracket 10 is mounted on the mailbox 40 and a hole is drilled in the top of the mailbox 40 in alignment with the hole 24 in the bracket 10. The bracket 10 is then secured to the mailbox by a fastener such as a common sheet metal screw 42.

Figure 4:
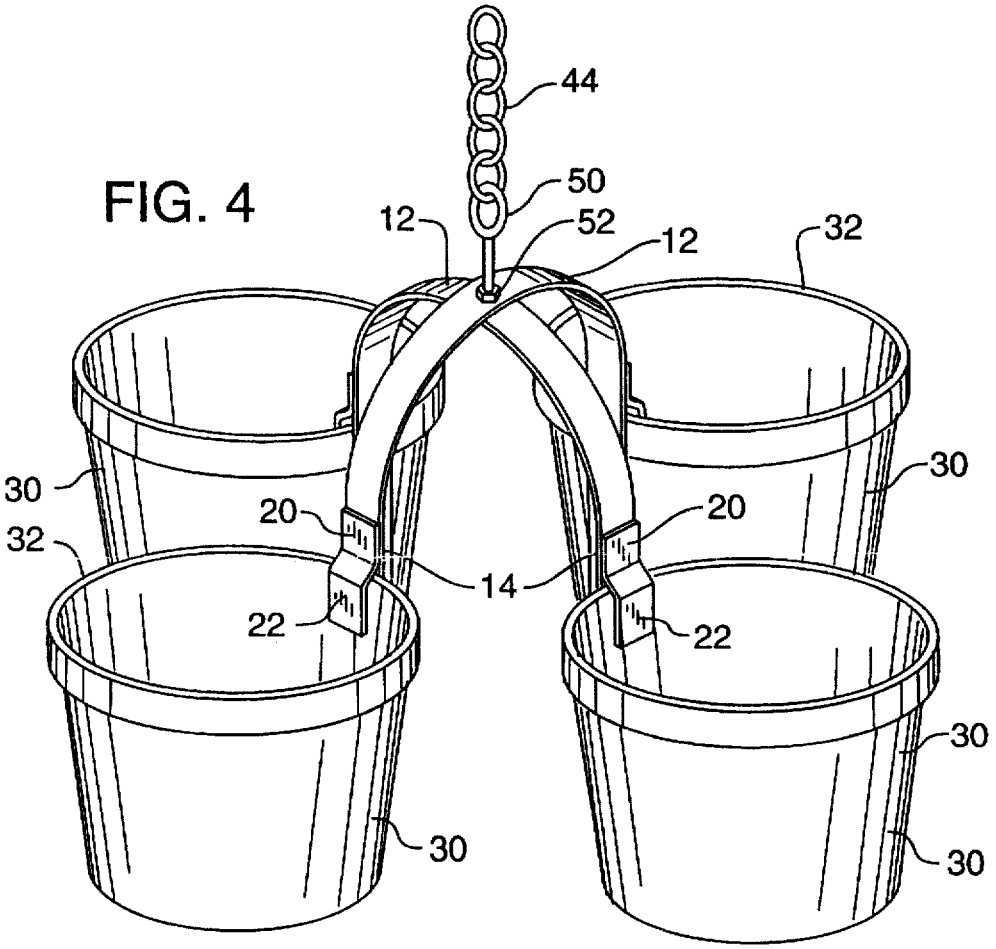
FIG. 4 is a perspective view of an assembly of two brackets suspended by a chain.

FIG. 4 illustrates in perspective view the mounting of two brackets 10, one to the other. The brackets 10 are positioned substantially normal to each other as illustrated and the holes 24 of each bracket are aligned one with the other. In this embodiment the brackets 10 are secured one to the other by a threaded eye bolt 50. A nut 52 is threaded onto the eye bolt 50 a sufficient distance so that the end 54 of the eye bolt will extend through both of the brackets 10. Another nut 52 (not visible in FIG. 4, see FIG. 2) is then threaded onto the end 54 of the eye bolt 50 and both of the nuts 52 are tightened in a conventional manner to secure the brackets 10 one to the other. The assembly of the brackets 10 of FIG. 4 by the eye bolt 52 provides a bracket assembly that may be readily hung from a hook or other device such as a chain 44 by utilizing the eye bolt 50. FIG. 4 illustrates the bracket assembly suspended from a device such as a chain 44.

Figure 5:
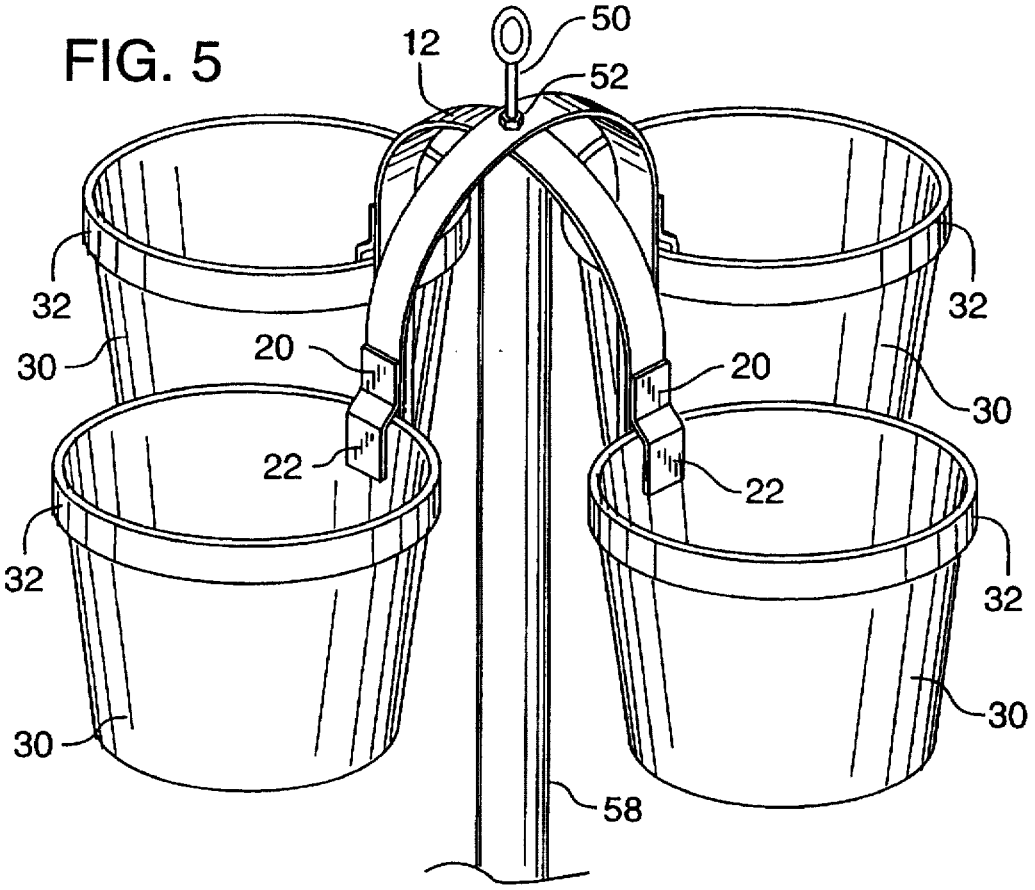
FIG. 5 is a view of an assembly of two brackets supported on a post.

FIG. 5 illustrates the bracket assembly of FIG. 4 mounted on a vertical support member such as a post 58. The bracket assembly is secured to the post 58 in a conventional manner. For example, if the post 58 is wooden, a hole is drilled in the top end of the post 58 and the eye bolt 50 is simply screwed into the hole provided in the post 58. The hole drilled in the top end of the post 58 may be provided with a sufficient diameter such that the end of the eye bolt 50 may be simply inserted into the hole and thus the bracket assembly may readily be removed or installed on the post 58.

Figure 6:
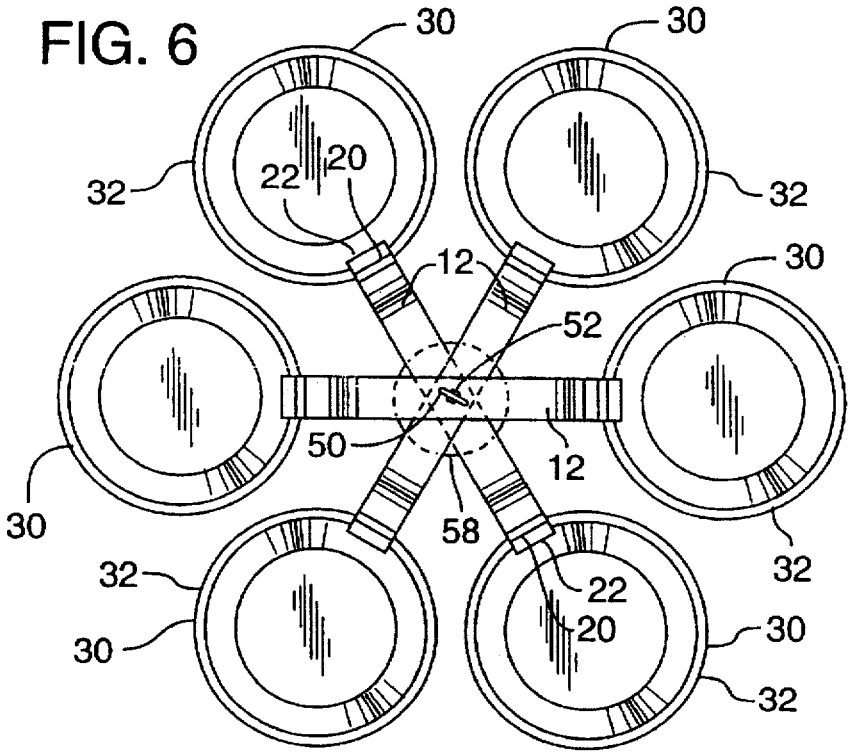
FIG. 6 is a top view of an assembly of three brackets supported on a post.

FIG. 6 illustrates three brackets 10 assembled together to form a bracket assembly that will support six planting pots. FIG. 6 illustrates the assembly of three brackets 10 supported on a post 58. The bracket assembly of FIG. 6 is secured to the post 58 in the same manner as the bracket assembly of FIG. 5.

The configuration of the bracket 10 of FIG. 1 provides for the ready assembly of multiple brackets to provide a bracket assembly that will support multiple planting pots.

Figure 7:
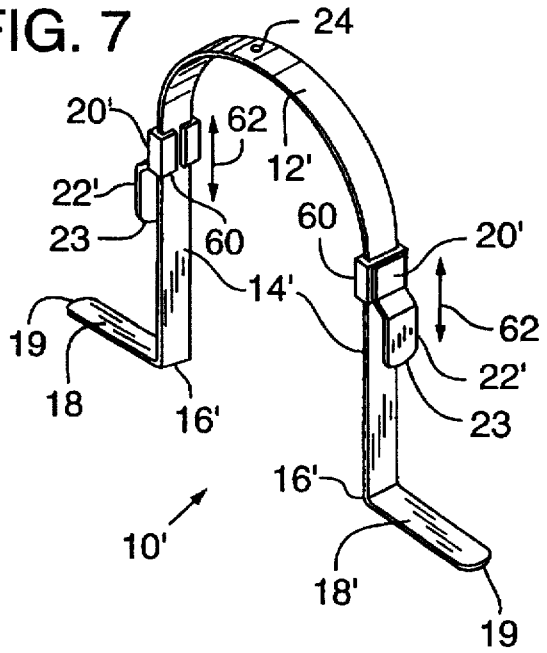
FIG. 7 is a perspective view of another embodiment of a pot supporting bracket of the present invention.

Refer to FIG. 7 which illustrates another embodiment of a pot supporting bracket 10' of the present invention. The bracket 10' of FIG. 7 is similar to the bracket 10 of FIG. 1 excepting that it has a provision for adjusting the clip 20' upwardly and downwardly relative to the base 18'. In this embodiment, the clip 20' is fixedly secured to a support member 60 as by welding. The support member 60 is configured to fit around the leg 14' of the bracket 10'. The support member 60 is configured to fit somewhat snugly on the leg 14' but it is slidably movable on the leg 14' and thus the clip 20' may be adjusted upwardly and downwardly toward and away from the base 18' as indicated by the arrow 62. The clip 20' of the bracket 10' may thus be adjusted to accommodate different heights of pots or containers 30.

In this embodiment, the end 23 of the lower portion 22' has a curved end 23 and the base portion 18' has a curved end 19.

Multiple brackets 10' of FIG. 7 may be assembled together in the same manner as the bracket 10 of FIG. 1 to form bracket assemblies.

Those skilled in the art will recognize that variations and modifications may be made without departing from the true spirit and scope of the invention. The invention is, therefore, not to be limited to the embodiments described and illustrated but is to be determined from the appended claims.

What is claimed is:

1. An arrangement of members, each supporting a pair of planting pots, comprising:

a plurality of formed members each having a crown, legs extending from the crown and a supporting base extending from each of the legs, each supporting base and leg configured to hold and receive a planting pot of said pair of planting pots with the pair of planting pots in spaced apart relation;

an aperture provided in the crown of each of the formed members, the formed members configured to enable the members to be interfit with the apertures of each in alignment;

a fastener; and said formed members assembled together by said fastener fitted in the aligned apertures for supporting multiple pairs of planting pots.

2. In combination, a post vertically secured at a desired position and having a top at a desired height, and an arrangement of multiple brackets as defined in claim 2, said arrangement of multiple brackets positioned on the top of the post with the fastener projected into the top of the post and securing the arrangement to the post.

3. In combination, a chain suspended from a structure and having a bottom end and an arrangement of multiple brackets as defined in claim 1, said fastener attached to the bottom end of the chain for hanging the arrangement suspended from the structure.

4. In combination, a mailbox having a curved outer surface and an end opening and an inverted U-shaped bracket comprising:

a bracket including a formed member having a crown configured as an inverted U to conform to the curved configuration of the mailbox, legs extending from the crown and a supporting base extending from each of the legs, each supporting base and leg configured to hold and receive a planting pot;

said bracket fitted to the exterior of the mailbox and planting pots supported by the bracket and containing decorative plants.

5. A bracket for supporting a pair of planting pots comprising:

a formed member having a crown, legs extending from the crown, and a supporting base extending from each of the legs, each supporting base and leg configured to hold and receive a planting pot of said pair of planting pots with the pair of planting pots in spaced apart relation;

the crown being curved in configuration and shaped to resemble an inverted U with spaced apart and depending legs defining a spacing between the legs; and the supporting bases being extensions of the legs extended laterally and outwardly from the spacing between the legs on which the potting plants are supported, and a clip mounted to each leg to engage an upper edge of the potting plant for securing the supported plant to the bracket.

6. A bracket for supporting a pair of planting pots as defined in claim 5 wherein:

the clip is adjustably movably mounted to each leg.

* * * * *